US007690404B2

(12) United States Patent
Marcus et al.

(10) Patent No.: US 7,690,404 B2
(45) Date of Patent: Apr. 6, 2010

(54) APPARATUS AND METHOD FOR EXPOSING A CONTAINER TO A CONTROLLED ENVIRONMENT

(75) Inventors: Frank F. Marcus, Lake In The Hills, IL (US); James J. Sanfilippo, Barrington Hills, IL (US); John E. Sanfilippo, Barrington Hills, IL (US)

(73) Assignee: Clear Lam Packaging, Inc., Elk Grove Village, IL (US)

( * ) Notice: Subject to any disclaimer, the term of this patent is extended or adjusted under 35 U.S.C. 154(b) by 752 days.

(21) Appl. No.: 11/405,227

(22) Filed: Apr. 17, 2006

(65) Prior Publication Data

US 2006/0231156 A1 Oct. 19, 2006

Related U.S. Application Data

(60) Provisional application No. 60/672,194, filed on Apr. 15, 2005.

(51) Int. Cl.
*B65B 1/04* (2006.01)
*B65B 31/00* (2006.01)

(52) U.S. Cl. ..... 141/92; 141/85; 141/89; 141/91; 141/11; 53/510

(58) Field of Classification Search ..... 141/7, 141/11, 69, 85, 89, 91, 92, 285, 286; 53/245, 53/246, 510, 511
See application file for complete search history.

(56) References Cited

U.S. PATENT DOCUMENTS 4,658,566 A 4/1987 Sanfilippo
4,905,454 A 3/1990 Sanfilippo et al.
5,001,878 A 3/1991 Sanfilippo et al.
5,069,020 A 12/1991 Sanfilippo et al.
5,228,269 A 7/1993 Sanfilippo et al.
5,417,255 A 5/1995 Sanfilippo et al.
5,617,705 A 4/1997 Sanfilippo et al.
5,816,024 A 10/1998 Sanfilippo et al.
5,911,249 A 6/1999 Sanfilippo et al.
5,916,110 A 6/1999 Sanfilippo et al.
5,918,616 A 7/1999 Sanfilippo et al.
5,961,000 A 10/1999 Sanfilippo et al.
6,032,438 A 3/2000 Sanfilippo et al.
6,221,411 B1 4/2001 Sanfilippo et al.
6,691,747 B1 2/2004 Marcus et al.

*Primary Examiner*—Timothy L Maust
(74) *Attorney, Agent, or Firm*—Wood, Herron & Evans, LLP

(57) ABSTRACT

An apparatus and method for exposing a container to a controlled environment. The apparatus includes an elongated rail with first, second, and third manifolds positioned in substantial alignment with the container. The first, second, and third manifolds are adapted for providing flow of a gas therethrough. At least one gas flow regulator is operably attached to the first, second, and third manifolds. At least one nozzle is positioned adjacent the second manifold. The at least one nozzle is adapted for providing a composite gas stream exiting through the second manifold. The method includes providing an elongated rail with first, second, and third manifolds positioned in substantial alignment with the container. A flow of a gas is regulated through the first, second, and third manifolds. A composite gas stream is provided exiting through the second manifold.

17 Claims, 4 Drawing Sheets

APPARATUS AND METHOD FOR EXPOSING A CONTAINER TO A CONTROLLED ENVIRONMENT

This application claims priority to U.S. Provisional Patent application 60/672,194 filed Apr. 15, 2005, the entirety of which is incorporated herein by reference.

TECHNICAL FIELD OF THE INVENTION

The invention relates to the packaging products within containers. More particularly, this invention relates to an apparatus and method for exposing a container to a controlled environment.

BACKGROUND OF THE INVENTION

Various products including food products, semiconductor products, medical products, and any other product that can have an adverse reaction to air, may be packaged in a controlled environment. Various attempts have been made to efficiently package these products in controlled environments using vacuum and/or controlled environments.

Various food products, including bakery goods, meats, fruits, vegetables, etc. are packaged under atmospheric conditions. Many of these products are presented in supermarkets, for example, in cartons or cardboard containers with a plastic or cellophane wrap covering the product.

One problem with this type of packaging is that the goods have a minimum limited shelf life, which for many products is only several days to a week. With bakery goods for example, mold may begin to grow after a few days under atmospheric conditions. Such products obviously cannot be sold or consumed and must be discarded.

Another problem arises with respect to many fruits and vegetables, which continue to ripen and continue their metabolic process under atmospheric conditions. For example, within a few days a banana can become overripe and undesirable to the consumer.

The space available for gassing operations is often limited at many facilities. In general, existing controlled environment systems are often expensive, bulky, and require three phase power, and, accordingly are impractical for use at many of these facilities.

In an effort to alleviate these problems, various attempts have been made to package food in a controlled environment by injecting controlled environment directly into filled containers. A high velocity flow is often necessary to penetrate into the food product. In general, most of these attempts have drawbacks. With bakery goods, for example, the high velocity jets can pull in air and re-contaminate the product, thereby failing to reduce the oxygen to levels that would prevent the normal onset of mold.

Various techniques for removing air in food filling processes are known in the art. Such processes are used, for example, in the packaging of nuts, coffee, powdered milk, cheese puffs, infant formula and various other dry foods. Typically, dry food containers are exposed to a controlled environment flush and/or vacuum for a period of time, subsequent to filling but prior to sealing. The product may also be flushed with a controlled environment prior to filling, or may be flushed after the filling process. When the oxygen has been substantially removed from the food contents therein, the containers are sealed, with or without vacuum. Various techniques are also known for replacing the atmosphere of packaged meat products with a modified atmosphere of carbon dioxide, oxygen and nitrogen, and/or other gases or mixtures of gases to extend shelf life.

One strategy for removing oxygen from food containers includes a conveyor belt that carries open top containers in a direction of movement directly below a gas flushing device. The gas flushing device supplies a controlled environment to the containers in two ways. First, a layer or blanket of low velocity flushing gas is supplied to the entire region immediately above and including the open tops of the containers through a distributing plate having a plurality of small openings. Second, each container is purged using a high velocity flushing gas jet supplied through a plurality of larger jet openings arranged side-by-side in a direction perpendicular to the direction of movement of the food containers. As the containers move forward, in the direction of movement, the steps of controlled environment blanketing followed by jet flushing can be repeated a number of times until sufficient oxygen has been removed from the containers and from the food contents therein.

One consideration of this strategy is that the flow of gas in a container is constantly changing. The high velocity streams are directed through perpendicular openings in a plate, which may create eddies near the openings causing turbulence which pulls in outside air. As a container moves past the perpendicular row of high velocity jets, the jets are initially directed downward into the container at the leading edge of the container's open top. As the container moves further forward, the flushing gas is directed into the center and, later, into the trailing edge of the open top, after which the container clears the row of jets before being exposed to the next perpendicular row of jets. The process is repeated as the container passes below the next row of jets.

This strategy is directed at flushing empty containers and, in effect, relies mainly on a dilution process to decrease oxygen levels. One perpendicular row of jets per container pitch may be inadequate to efficiently remove air contained in food product.

Constantly changing jet patterns in such prior art devices may create turbulence above and within the containers, which causes surrounding air to be pulled into the containers by the jets. This turbulence may also impose a limitation on the speed at which the containers pass below the jets. As the containers move faster beneath the jets, the flow patterns within the containers change faster, and the turbulence increases. Also, at high line speeds, purging gas has more difficulty going down into the containers because of the relatively shorter residence time in contact with each high velocity row. The purging gas also has a greater tendency to remain in the head space above the containers. In addition, a perpendicular arrangement of jets relative to the direction of container travel causes much of the jet to be directed outside the containers, especially when the containers are round. Moreover, the spacing apart of the perpendicular rows may further vary the flow pattern and pull outside air into the containers.

Therefore, it would be desirable to provide a strategy for exposing a container to a controlled environment that overcomes the aforementioned and other disadvantages.

SUMMARY OF THE INVENTION

One aspect of the present invention provides an apparatus for exposing a container to a controlled environment. The apparatus includes an elongated rail with first, second, and third manifolds positioned in substantial alignment with the container. The first, second, and third manifolds are adapted for providing flow of a gas therethrough. At least one gas flow regulator is operably attached to the first, second, and third manifolds. At least one nozzle is positioned adjacent the second manifold. The at least one nozzle is adapted for providing a composite gas stream exiting through the second manifold.

Another aspect of the invention provides a method of exposing a container to a controlled environment. The method includes providing an elongated rail with first, second, and third manifolds positioned in substantial alignment with the container. A flow of a gas is regulated through the first, second, and third manifolds. A composite gas stream is provided exiting through the second manifold.

Another aspect of the invention provides an apparatus for exposing a container to a controlled environment. The apparatus includes an elongated rail including first, second, and third manifolds positioned in substantial alignment with the container. The apparatus further includes means for regulating flow of a gas through the first, second, and third manifolds; and means for providing a composite gas stream exiting through the second manifold.

The foregoing and other features and advantages of the invention will become further apparent from the following detailed description of the presently preferred embodiments, read in conjunction with the accompanying drawings. The detailed description and drawings are merely illustrative of the invention, rather than limiting the scope of the invention being defined by the appended claims and equivalents thereof.

DETAILED DESCRIPTION OF THE PRESENTLY PREFERRED EMBODIMENTS

Figure 1:
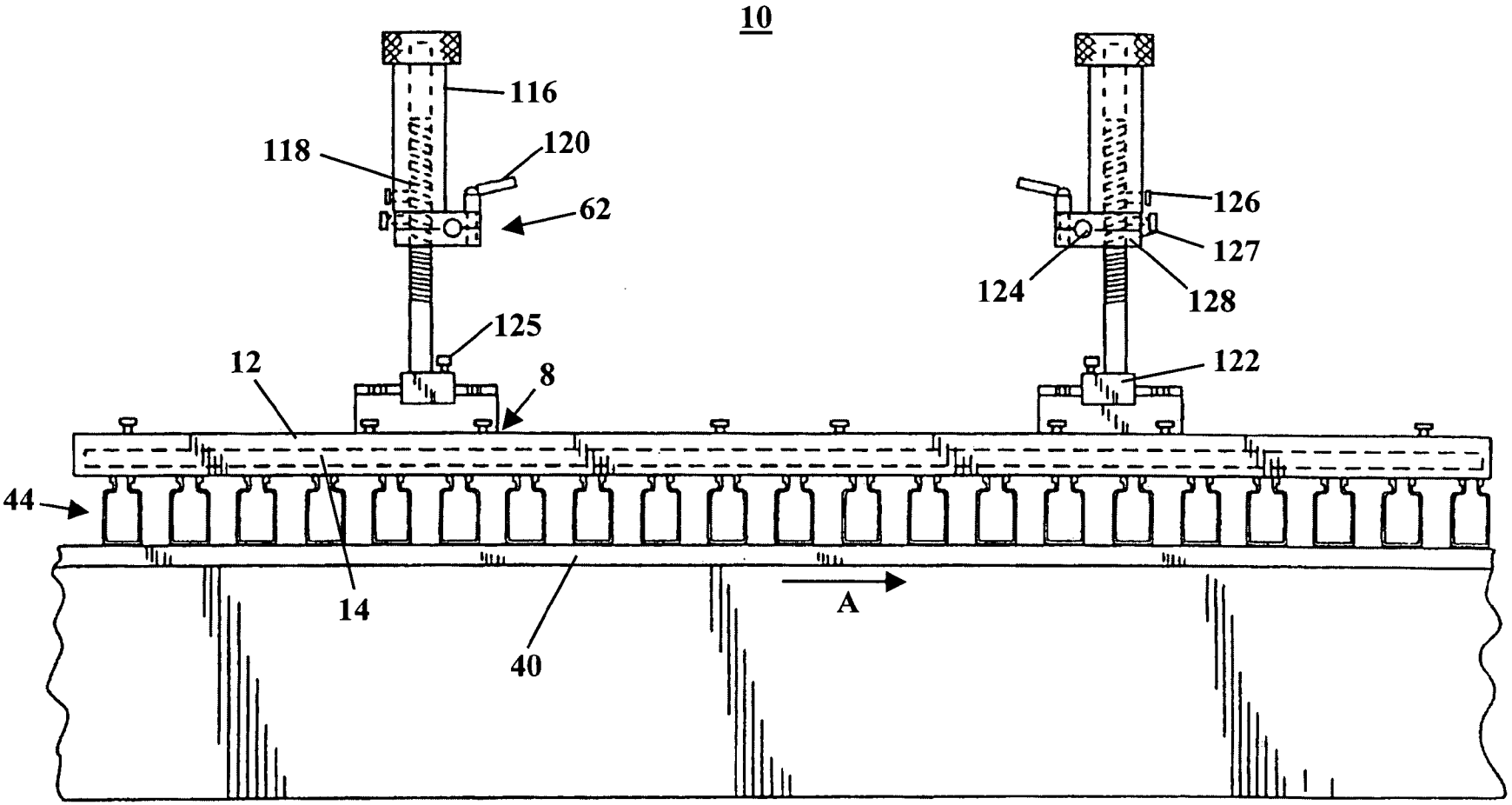
FIG. 1 is a perspective view of an apparatus for exposing a container to a controlled environment, in accordance with one embodiment of the present invention.

Referring to the drawings, wherein like reference numerals refer to like elements, FIG. 1 is a perspective view of an apparatus, shown generally by numeral 10, for exposing a container 44 to a controlled environment, in accordance with one embodiment of the present invention. Those skilled in the art will recognize that the configuration of the apparatus 10 may vary from the present description and figures. The applicants contemplate numerous modifications to the assembly 10 that may be adapted for use with the present invention. In addition, the nature, configuration, size, geometry, number, and contents of the container 44 may vary. For example, the container 44 may be in the form of a bottle, package, product, and the like with or without content(s) contained therein.

In one embodiment, the apparatus 10 is positioned above a plurality of containers 44 that are carried in a direction of travel A by a conveyer belt 40. A height adjusting apparatus 62 may be included to provide means for positioning the apparatus 10 to a desired distance relative to various sized containers 44 positioned on the conveyer belt 40. Height adjusting apparatus 62 also provides means for removing the apparatus 10 for cleaning, maintenance, or other purposes. Height adjusting member 62 may include an adjustment knob 116, a vertical threaded shaft 118, a horizontal mounting shaft 124, a port block bracket 122, and a mounting block 128. Horizontal mounting shaft 124 may manufactured from stainless steel or other rigid material. Horizontal mounting shaft 124 may be secured to the floor or other rigid structure by numerous means. Horizontal mounting shaft 124 may slidably fit within an opening formed in mounting block 128, which may also be manufactured from stainless steel or other rigid material. A horizontal adjusting handle 120 may be used to secure the shaft 124 to the mounting block 128, and may be operated to allow the mounting block 128 and, thus, the apparatus 10 be moved in a horizontal direction into an improved position with respect to the containers 44. Vertical threaded shaft 118 may be screwably received within the adjusting knob 116, and fastened to the mounting block 128. An adjusting screw 125 may be provided to allow the apparatus 10 to be positioned horizontally while loosened. Plunger 126, which is preferably spring-loaded, may be pulled horizontally outward from its engagement with a groove formed in the vertical threaded shaft 118 to allow vertical positioning of the apparatus 10 relative to the conveyer belt 40. A thumb screw 127 may be provided to tighten the mounting block 128 and adjusting knob 116. Fine vertical positioning of the apparatus 10 relative to the conveyer belt 40 may be accomplished by turning the adjustment knob 116.

Figure 2:
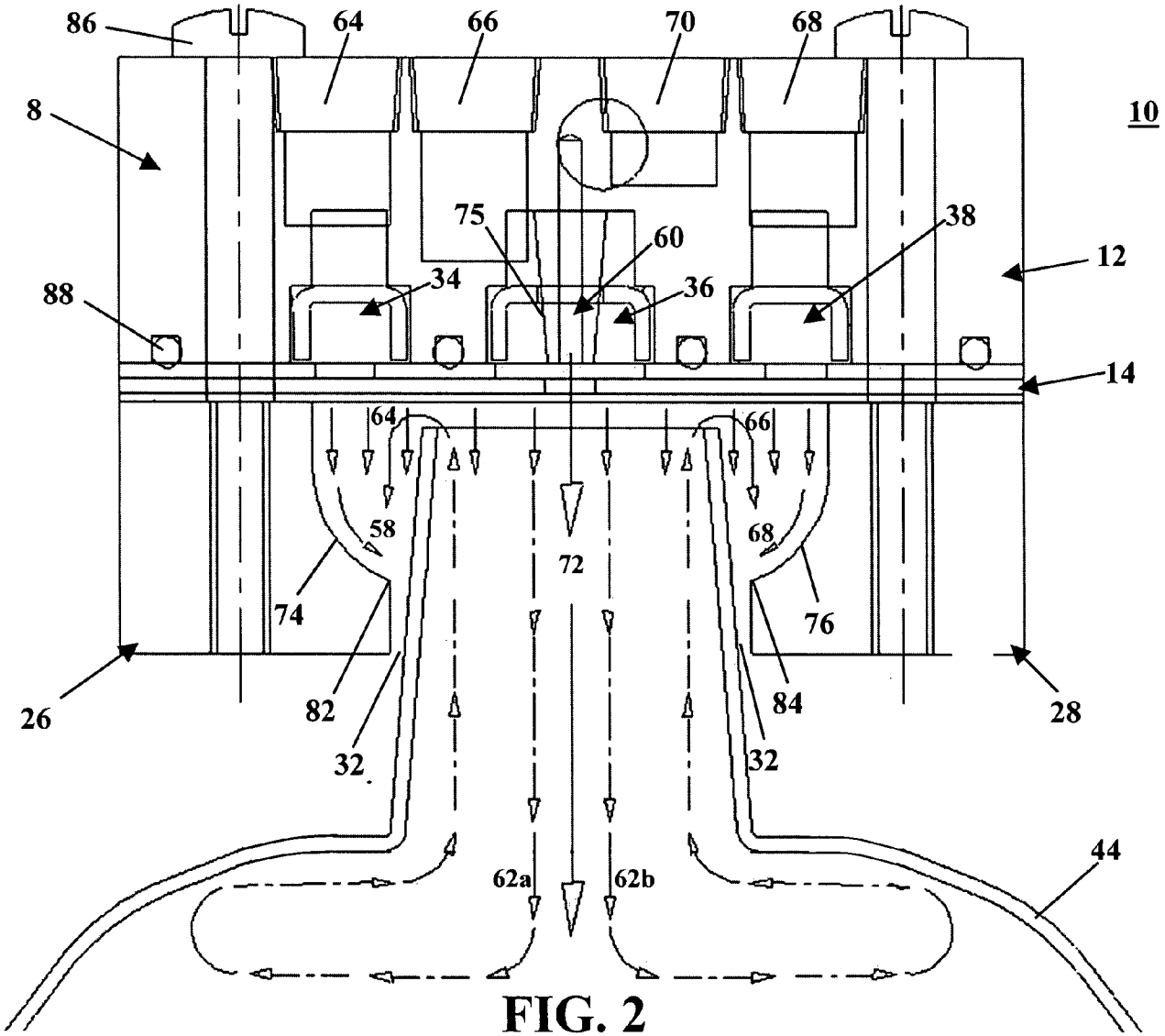
FIG. 2 is a perspective view of a purge gas rail apparatus, in accordance with a first embodiment of the present invention.
Figure 3:
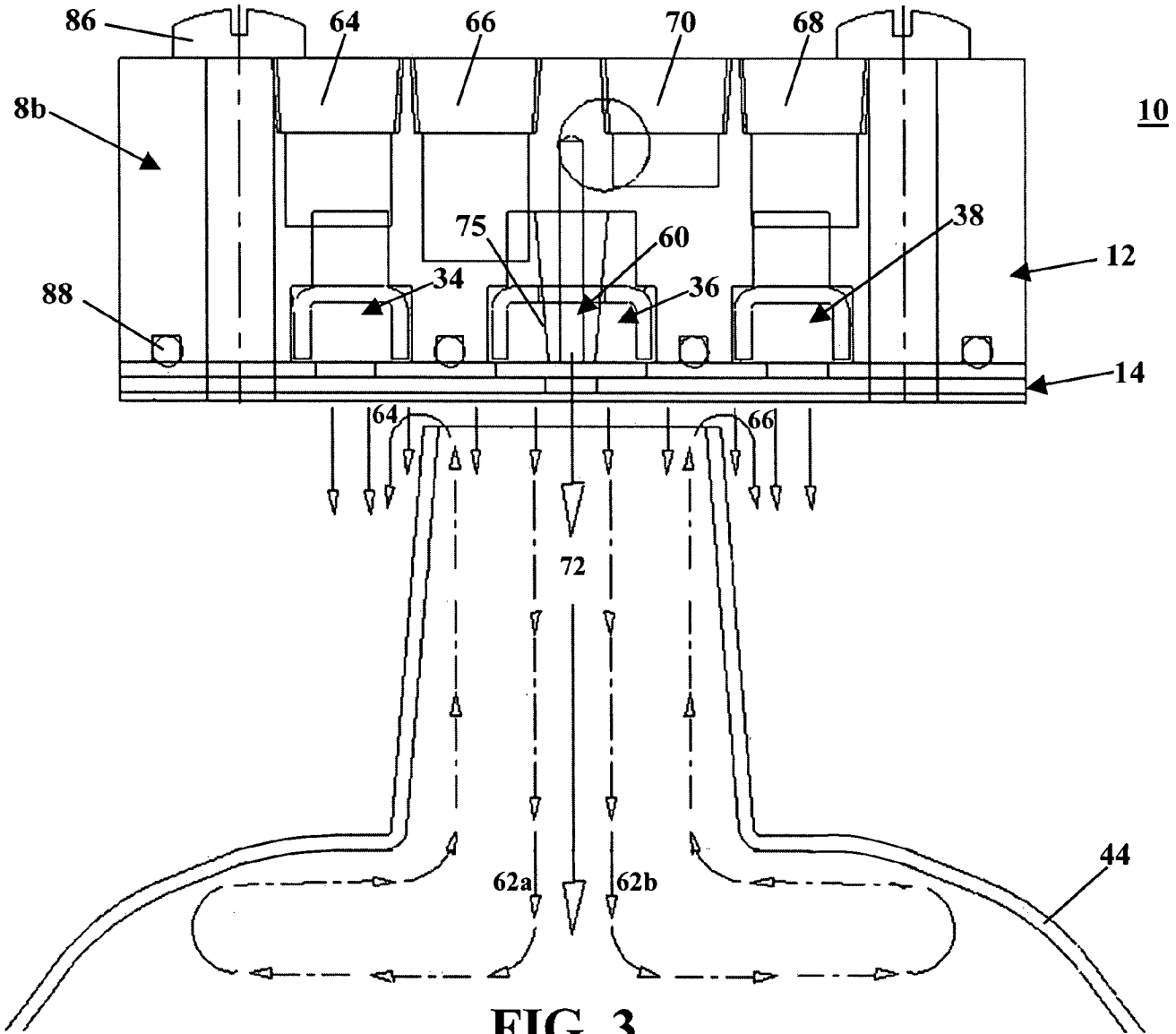
FIG. 3 is a perspective view of a pre-purge gas rail apparatus, in accordance with a second embodiment of the present invention.

Apparatus 10 includes an elongated rail 8, which is also shown in FIGS. 2 and 3, positioned in substantial alignment with the container 44 during operation. In one embodiment, the elongated rail 8 is preferably is at least as wide, and more preferably, somewhat wider, than the opening formed in the container 44. In another embodiment, the elongated rail 8 is narrower than the container 44 opening, but under certain conditions, this may allow outside air to contaminate the container 44. Additional structure or other means may be combined with the narrower elongated rail 8 to maintain a controlled environment within the container 44. The length of the elongated rail 8 may vary depending on the desired line speed and minimum residence time underneath the elongated rail 8 for each container 44. Also, a plurality of elongated rail sections may be arranged lengthwise in series to create a greater "effective" length. The actual length or number of elongated rail sections required will depend on various factors, including conveyor speed, container and product volume, and product type. Additionally, the elongated rail 8 may be controlled to follow various production guidelines (i.e., it may be curved).

In one embodiment, the elongated rail 8 may include an elongated rail top member 12 and an elongated rail base member 14. Preferably, the elongated rail top member 12 and the elongated rail base member 14 are in longitudinal communication with each other; that is, they are situated parallel with each other substantially throughout the length of the elongated rail 8 in a manner such that the elongated rail top member 12 may be located directly above the elongated rail base member 14.

Although referred to herein as "elongated rail top member" and "elongated rail base member," it is contemplated that the elongated rail 8 may be inverted or positioned in various configurations where the elongated rail top member 12 is not completely disposed over the elongated rail base member 14.

FIGS. 2 and 3 are side perspective views of an elongated rail 8 in accordance with first and second embodiments of the present invention. Elongated rail 8 includes first, second, and third manifolds 34, 36, 38 positioned in substantial alignment with the container 44. Specifically, the second manifold 36 is positioned directly above an opening of the container 44 and flanked by the first manifold 34 and the third manifold 38. Manifolds 34, 36, 38 are adapted for providing a flow of gas therethrough. Gas may be, for example, one or more controlled environmental gases for preserving the contents of the container 44 (e.g., nitrogen, helium, etc.). A gas flow regulator 35, 39 is operably attached to each of the manifolds 34, 36, 38. At least one, and in this case one, nozzle 60 is positioned adjacent the second manifold 36. As described in further detail below, the nozzle 60 is adapted for providing a composite gas stream exiting through the second manifold 36.

In one embodiment, gas is provided to the first, second, and third manifolds 34, 36, 38 via corresponding first, second, and third gas inlet 64, 66, 68. Gas may be provided to the nozzle 60 via a nozzle gas inlet 70. The gas flowing from each of the manifolds 34, 36, 38 need not be of the same type and flow rate. Further, it is preferable that the gas moving through the nozzle 60 flows at a substantially faster rate than that from the second manifold 36. This provides a deeper penetration of the gas into the container 44 as well as allows acceleration of the gas exiting from the second manifold 36. The flow of the gas into the container 44 is preferably at a rate that will effectively purge the existing atmosphere therein and is typically based on the size and shape of the container 44 and any product(s) contained therein. In one embodiment, nozzle gas inlet 70 may receive a high-pressure gas and inlet 36 may receive a low-pressure gas. For example, the first and third gas inlets 64, 68 may be operated at, for example, 10-40 LPM. Second gas inlet 66 may be operated at, for example, 30-100 LPM. Nozzle gas inlet may be operated at, for example, 200-400 LPM.

Figure 4:
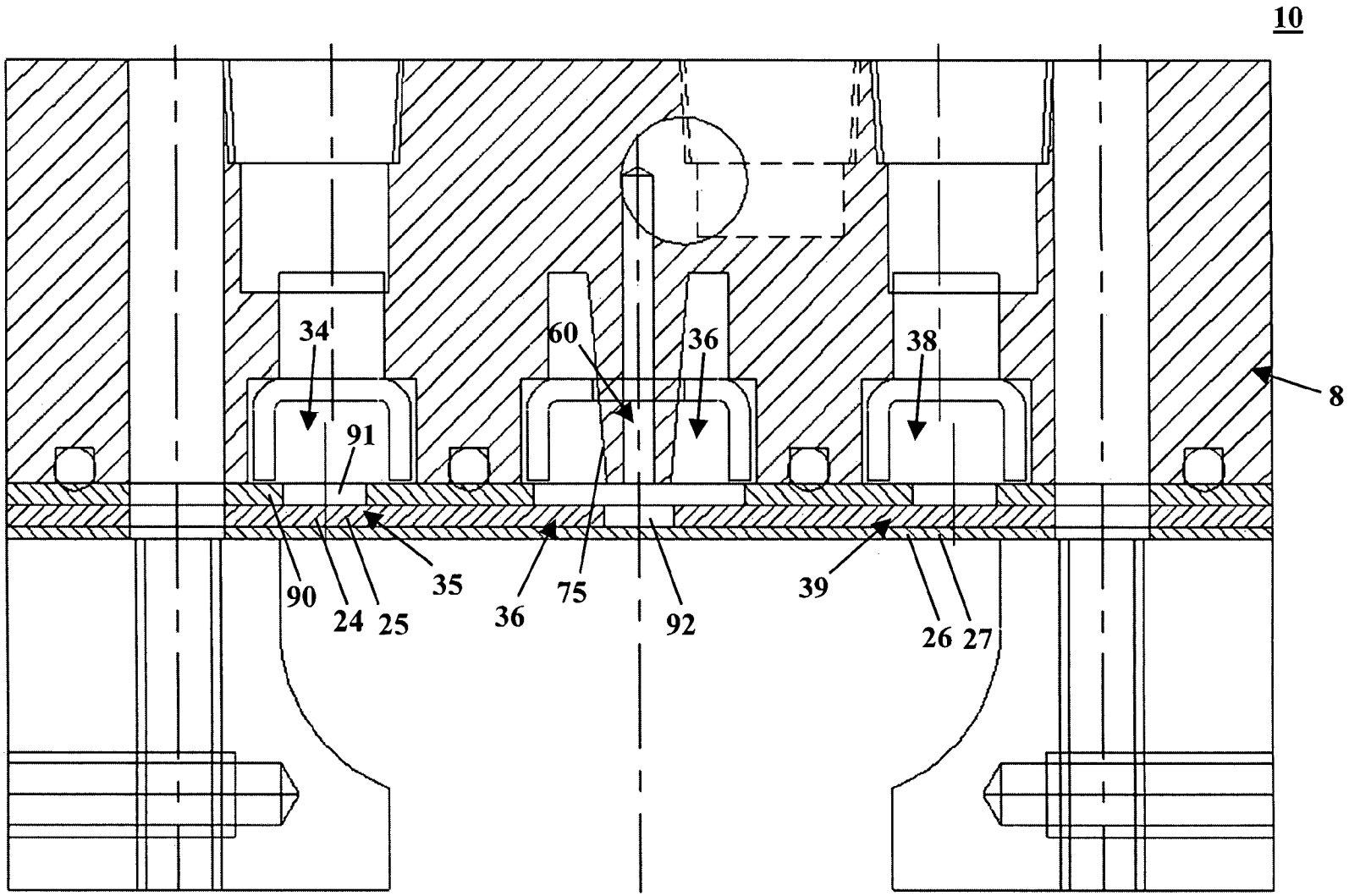
FIG. 4 is a perspective view of gas deflecting members, in accordance with the first embodiment of the present invention.

As shown in FIG. 4, the gas flow regulators 35, 39 include a network of apertures 25, 27 formed therein. Specifically, the gas flow regulators 34, 38 includes a plate 90 including an aperture 91 formed therein and laminar screen members 24, 26 which controls the outflow of the gas through the first and third manifolds 34, 38. Laminar screen members 24, 26 may be, for example, an upper 5-ply wire screen and a lower 2-ply wire screen, respectively, including the network of apertures 25, 27 formed therein. The apertures 25, 27 may generally decrease in size as the gas flows therethrough to provide a homogenous exit of gas flow through the first and third manifolds 35, 39 (i.e., the gas flow is evenly dispersed). Gas flow regulator 36 may be a differential gas flow regulator. Specifically, the gas flow regulator 36 may be substantially similar to gas flow regulators 35, 39 with one exception. In one embodiment, an aperture 92 is formed in the laminar screen member 24 positioned below the nozzle 60 so that gas exiting therethrough retains more of its velocity. In other embodiments, at least one aperture 92 is placed below first and third manifolds 34 and 38. In embodiments featuring more than one aperture 92, each individual aperture 92 can be similarly or dissimilarly sized to the other apertures 92.

Referring to FIGS. 2-4, during operation, gas may be provided to the inlets 64, 66, 68, 70 and flow through the manifolds 34, 36, 38 and nozzle 60. In one embodiment, an outer surface of nozzle 60 tapers (i.e., narrows) as it approaches the gas flow regulator 39. Nozzle 60 may be positioned in about the center of the second manifold 36 to provide improved penetration of gas flow into the container 44. Gas may exit the first and third manifolds 34, 38 in a homogenous fashion at a relatively slow rate. Gas may exit the second manifold 36 at a rate preferably faster than that of the first and third manifolds 34, 38. In addition, gas may exit the nozzle 60 at a rate preferably substantially faster than that of the second manifold 36. Gas exiting the nozzle 60 and second manifold 36 may be a composite gas stream. Specifically, the composite gas stream may include the relatively slower moving gas stream exiting from the second manifold 36, which substantially encompasses the relatively faster moving gas stream exiting from the nozzle 60. Gas from the second manifold 36 is accelerated as it interacts with the gas exiting from the nozzle 60 due to friction between the gas streams. As the gas exiting from the nozzle 60 is essentially shrouded by gas exiting from the second manifold 36, any unwanted gases, such as oxygen, are prevented from entering the container 44. As such, the container 44 is deeply penetrated with predominantly the controlled environment gas.

As used herein, a "composite gas stream" is a flow of gas including substreams flowing at a speed different from a speed of at least one other substream in the composite gas stream.

As shown in FIG. 2, the elongated rail 8 may include gas deflecting member 26, 28 positioned adjacent to the first and third manifolds 34, 38. Each of the deflecting members 26, 28 may have an arcuate shape, with an end region 82, 84, respectively. The end regions 82, 84 may be generally shaped in a direction approaching a perpendicular direction to the container 44 or parallel with the elongated rail base member 14. As a result, each of the deflecting members 26, 28 may be contoured to deflect the flow of the gas exiting the first and third manifolds 34, 38. More specifically, the deflecting member 26 may be shaped to direct the flow of the gas (along the path shown by arrow 58) exiting from the first manifold 34 around an arcuate curve 74 and out of an elongated open region 32. Similarly, the deflecting member 28 may be shaped to direct the flow of the gas (along the path shown by arrow 68) exiting from the third manifold 38 around the arcuate curve 76 and out of the elongated open region 32. Gas exiting from the second manifold 36 and nozzle 60 may enter the container 44, flows throughout the container 44 (substantially along the path shown by arrows 62*a*, 62*b*, and 72) and eventually flow out of the container 44 (substantially along the path shown by arrows 64, 66). As a result of the air flow created by the gas exiting from the first and third manifolds 34, 38, the controlled environment gas flowing out of the container (along arrows 64, 66) then exits the elongated open region 32. In addition, a lateral barrier shield of air is produced to prevent migration of outside gasses (e.g., oxygen) into the container 44.

Both the elongated rail base member 12 and the elongated rail top member 14 may be manufactured from a number of materials capable of achieving the purposes of the present invention, such as, for example, stainless steel or plastic. Furthermore, the elongated rail top member 12 and the elongated rail base member 14 may be attached to each other by any known means, such as for example, through a screw 86 or through a nut-and-bolt assembly. Additionally, the deflecting members 26, 28 may also be made of any known material capable of achieving the purposes of the present invention, such as, for example, stainless steel or plastic. The attachment of the deflecting members 26, 28 to the elongated rail base member 14 may be by any known means, such as, for example, through a screw or nut-and-bolt assembly. The attachment means described here may further include a plurality of o-rings 88 to reduce gas flow between the facing surfaces of elongated rail top member 12 and elongated rail base member 14.

As shown in FIG. 3, elongated rail 8*b* may be designed and implemented without deflecting members. In such an embodiment, a Venturi effect may still apply to direct the flow of the controlled environment gas out of the container 44. To achieve this, the first and third manifolds 34, 38 may be positioned in a location such that the flow of the gas is substantially proximate to the edge of the container 44. As a result, the Venturi effect of the flows (arrows 58 and 68) causes gas exiting the container 44 (arrows 64 and 66). This embodiment may be utilized to purge a larger container 44 without disturbing the product contained within.

While the embodiments of the invention disclosed herein are presently considered to be preferred, various changes and modifications can be made without departing from the spirit and scope of the invention. For example, the apparatus and method for exposing a container to a controlled environment are not limited to any particular design or sequence. Specifically, the elongated rail, the manifolds, the gas flow regulators, the nozzle, and method of operating the same may vary without limiting the utility of the invention.

Upon reading the specification and reviewing the drawings thereof, it will become immediately obvious to those skilled in the art that myriad other embodiments of the present invention are possible, and that such embodiments are contemplated and fall within the scope of the presently claimed invention. The scope of the invention is indicated in the appended claims, and all changes that come within the meaning and range of equivalents are intended to be embraced therein.

The invention claimed is:

1. An apparatus for exposing a container to a controlled environment, the apparatus comprising:

an elongated rail including first, second, and third manifolds positioned in substantial alignment with the container, said manifolds adapted for providing flow of a gas therethrough;

at least one gas flow regulator operably attached to the first, second, and third manifolds; and at least one nozzle extending into said manifold, said nozzle positioned adjacent the second manifold;

wherein the at least one nozzle and said second manifold being oriented in combination to produce a composite gas stream exiting through the second manifold.

2. The apparatus of claim 1 wherein the gas flow regulator comprises a differential gas flow regulator.

3. The apparatus of claim 1 wherein the gas flow regulator comprises a network of apertures formed therein, the apertures generally decreasing in size as the gas flows therethrough.

4. The apparatus of claim 1 wherein the second manifold comprises a tapered shape.

5. The apparatus of claim 1 wherein the at least one nozzle is positioned in about the center of the second manifold.

6. The apparatus of claim 1 wherein the composite gas stream comprises at least two substreams flowing at a speed different from a speed of at least one other substream.

7. The apparatus of claim 1 wherein the composite gas stream comprises a slower moving gas stream exiting from the second manifold, the slower moving gas stream substantially encompassing a faster moving gas stream exiting from the at least one nozzle.

8. The apparatus of claim 1 further comprising gas deflecting members positioned adjacent to the first and third manifolds; wherein the gas deflecting members are contoured to deflect the gas exiting the first and third manifolds.

9. The apparatus of claim 1 further comprising:

a first inlet in fluid communication with the nozzle for receiving a high-pressure gas; and a second inlet separate from said inlet and in fluid communication with the second manifold for receiving a low-pressure gas.

10. A method of exposing a container to a controlled environment, the method comprising:

regulating flow of a gas through the first, second, and third manifolds disposed in an elongated rail in substantial alignment with a container;

flowing gas from a nozzle within a second manifold in one stream;

flowing gas from said second manifold in another stream; and directing a composite stream of gas of said two streams toward a container from said second manifold.

11. The method of claim 10 wherein regulating flow of the gas comprises differentially regulating flow of the gas.

12. The method of claim 10 wherein regulating flow of the gas comprises dispersing flow of the gas.

13. The method of claim 10 wherein said directing step includes accelerating said gas in said other stream exiting the second manifold.

14. The method of claim 10 wherein the other gas stream comprises a slower moving gas stream exiting from the second manifold, the method including encompassing a faster moving gas stream exiting from the at least one nozzle with the second gas stream flowing from the second manifold at a slower moving speed.

15. The method of claim 10 further comprising centering the composite gas stream through the second manifold.

16. The method of claim 10 further comprising deflecting the flow of the gas exiting the first and third manifolds.

17. The method of claim 10 further comprising applying low-pressure gas stream to the second manifold and a higher-pressure gas stream to the nozzle within the second manifold.

* * * * *